US007947420B2

(12) United States Patent
Matsubara et al.

(10) Patent No.: US 7,947,420 B2
(45) Date of Patent: May 24, 2011

(54) IMAGE FORMING METHOD

(75) Inventors: Masaharu Matsubara, Tokyo (JP); Asao Matsushima, Tokyo (JP); Noboru Ueda, Tokyo (JP); Go Yamaguchi, Tokyo (JP); Takayuki Suzuki, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 693 days.

(21) Appl. No.: 12/015,670

(22) Filed: Jan. 17, 2008

(65) Prior Publication Data

US 2008/0226364 A1 Sep. 18, 2008

(30) Foreign Application Priority Data

Feb. 26, 2007 (JP) ..... 2007-045319

(51) Int. Cl.
*G03G 15/20* (2006.01)

(52) U.S. Cl. ..... 430/124.11; 430/124.3; 430/124.33; 430/124.35; 399/329; 399/333

(58) Field of Classification Search ..... 430/124.11, 430/142.3, 124.33, 124.35; 399/333, 329
See application file for complete search history.

(56) References Cited

U.S. PATENT DOCUMENTS

2005/0271408 A1* 12/2005 Hayashi ..... 399/70
2006/0127142 A1* 6/2006 Nakamoto et al. ..... 399/329
2006/0165447 A1* 7/2006 Onodera ..... 399/329
2007/0048046 A1* 3/2007 Tamemasa ..... 399/333
2008/0124145 A1* 5/2008 Amico ..... 399/329

FOREIGN PATENT DOCUMENTS

EP 1 813 992 * 8/2007

* cited by examiner

*Primary Examiner* — Hoa V Le
(74) *Attorney, Agent, or Firm* — Lucas & Mercanti, LLP

(57) ABSTRACT

An image forming method comprising the steps of: (i) charging a surface of a photoreceptor; (ii) exposing the charged photoreceptor to form an electrostatic latent image; (iii) developing the electrostatic latent image using a toner comprising at least a release agent to form a toner image; (iv) transferring the toner image on the photoreceptor to a transfer material; and (v) fixing the toner image transferred on the transfer material employing a contact-heating fixing devise comprising a pair of belts, wherein the releasing agent comprises a first release agent component containing a monoester compound represented by Formula (1) and a second release agent component containing a hydrocarbon having a branched chain structure, wherein a content of the first release agent is 40 to 98% by mass, based on a total mass of the first release agent component and the second release agent component:

$R_1$—COO—$R_2$. Formula (1)

17 Claims, 3 Drawing Sheets

IMAGE FORMING METHOD

This application is based on Japanese Patent Application No. 2007-045319 filed on Feb. 26, 2007 in Japanese Patent Office, the entire content of which is hereby incorporated by reference.

TECHNICAL FIELD

The present invention relates to an image forming method.

BACKGROUND OF THE INVENTION

In recent years, according to the demand for energy conservation of an image forming apparatus by the electrophotographic method, low-temperature fixing for fixing at a lower temperature is in progress, in order to reduce the consumption energy of the fixing device which consumes the largest power in the image forming apparatus.

To realize the low-temperature fixing, it is necessary to fuse a binder resin and a release agent in a toner at a low fixing temperature. For that purpose, generally, as a binder resin and a release agent (wax) in the toner, it may be considered to use ones having a low melting viscosity.

Furthermore, to obtain a toner suitable for a lower fixing temperature, it is necessary to use a release agent having a lower melting point Accordingly, a toner suitable for low-temperature fixing using a release agent having a low-melting point (hereinafter, also referred to as a "low melting point release agent") has been proposed (for example, refer to Patent Documents 1 and 2).

Furthermore, from the viewpoint of the global environment preservation, reduction in energy consumption by the image forming apparatus is required, and in addition to development of the aforementioned toner suitable for low-temperature fixing, improvement of the fixing efficiency of the fixing device has been studied. As one of such fixing devices, in place of the conventional fixing device using a combination of a heating roller and a pressing roller, a fixing device having a belt-type heating body and a belt-type pressing body up and down has been proposed (for example, refer to Patent Documents 3 and 4).

This fixing device employs belt-type members in the heating and pressing section, whereby the width of the nip at the fixing part is broadened, and the fixing efficiency is improved.

However, when fixing is carried out using the proposed toner for low-temperature fixing in a high speed image forming apparatus (for example, an image forming apparatus of 40 sheets/minute with lateral direction feeding of A4 sized sheets) with a contact-heating fixing devise having a paired-belt constitution made up of a belt-type heating body and a belt-type pressing body mounted, problems arise that belt-shaped or stripe-shaped image defects are found on a fixed image and when obtained prints are piled up and left for a while, a document offset tends to occur.

When a toner image is fixed at a lower fixing temperature in order to solve the aforementioned problems, the belt-shaped image defect or stripe-shaped image defect is suppressed, however, the fixing property (fixing strength) is lowered.

Development of an image forming apparatus is desired, in which belt-shaped or stripe-shaped image defects are suppressed, print images having enough fixing strength are obtained and only limited print offset occurs after storing piled print images, even when fixing is carried out at a lower temperature in a high-speed image forming apparatus containing a contact-heating fixing devise having a paired-belt constitution.

Patent Document 1: Japanese Patent Application Publication Open to Public Inspection (hereafter referred to as JP-A) No. 2000-321815

Patent Document 2: JP-A No. 2000-275908

Patent Document 3: JP-A No. 7-140815

Patent Document 4: JP-A No. 2002-365948

SUMMARY OF THE INVENTION

Problems to be Solved by the Invention

An object of the present invention is to provide an image forming method by which a sufficient fixing strength and excellent print images without belt-shaped or stripe-shaped image defects are obtained and only limited print offset are observed after storing piled print images, even when fixing is carried out at a lower temperature (for example, at 120° C.) in a high-speed image forming apparatus (for example, 40 sheets/minute).

One of the aspects to achieve the above object of the present invention is an image forming method comprising the steps of: (i) charging a surface of a photoreceptor; (ii) exposing the charged photoreceptor to form an electrostatic latent image; (iii) developing the electrostatic latent image using a toner comprising at least a release agent to form a toner image; (iv) transferring the toner image on the photoreceptor to a transfer material; and (v) fixing the toner image transferred on the transfer material employing a contact-heating fixing devise comprising a pair of belts, wherein the releasing agent comprises a first release agent component containing a monoester compound represented by Formula (1) and a second release agent component containing a hydrocarbon having a branched chain structure, wherein a content of the first release agent is 40 to 98% by mass, based on a total mass of the first release agent component and the second release agent component:

$$R_1—COO—R_2 \qquad \text{Formula (1)}$$

wherein $R_1$ and $R_2$ each represent a substituted or non-substituted hydrocarbon group with a main chain having 13-30 carbon atoms, and $R_1$ and $R_2$ may be the same or different.

DESCRIPTION OF THE PREFERRED EMBODIMENTS

Figure 1:
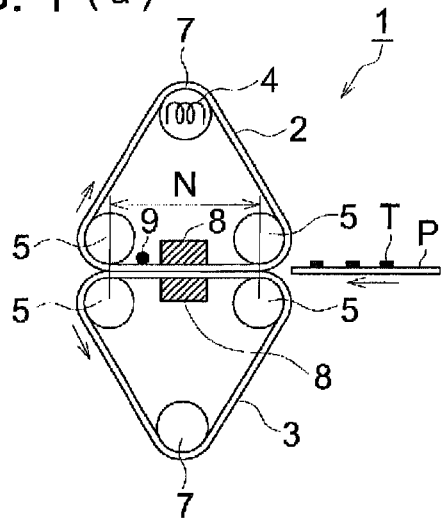
FIGS. 1(*a*)-1(*e*) are schematic diagrams showing examples of the fixing devices of the contact heating system, each having a heating belt and a pressing belt.
Figure 1:
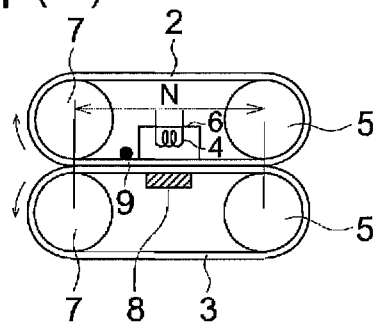
Figure 1:
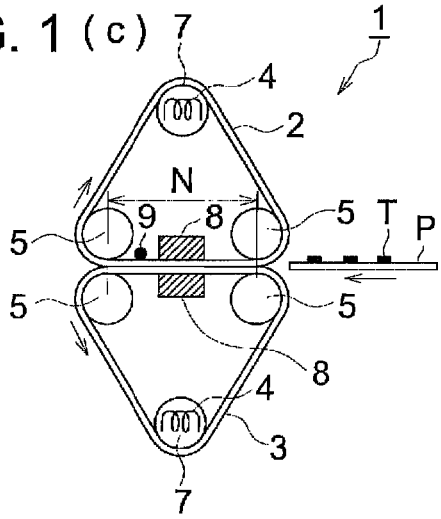
Figure 1:
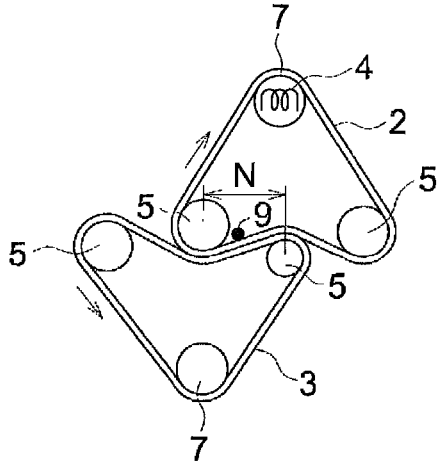
Figure 1:
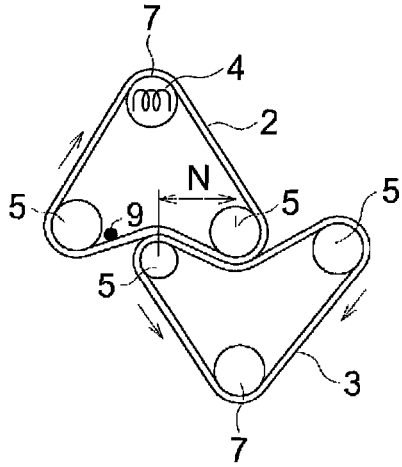

The above object of the present invention is achieved by the following structures 1. An image forming method comprising the steps of:

(i) charging a surface of a photoreceptor;

(ii) exposing the charged photoreceptor to form an electrostatic latent image;

(iii) developing the electrostatic latent image using a toner comprising at least a release agent to form a toner image;

(iv) transferring the toner image on the photoreceptor to a transfer material; and (v) fixing the toner image transferred on the transfer material employing a contact-heating fixing devise comprising a pair of belts, wherein the releasing agent comprises a first release agent component containing a monoester compound represented by Formula (1) and a second release agent component containing a hydrocarbon having a branched chain structure, wherein a content of the first release agent is 40 to 98% by mass, based on a total mass of the first release agent component and the second release agent component:

$$R_1—COO—R_2 \quad \text{Formula (1)}$$

wherein $R_1$ and $R_2$ each represent a substituted or non-substituted hydrocarbon group with a main chain having 13-30 carbon atoms, and $R_1$ and $R_2$ may be the same or different.

2. The image forming method of Item 1, wherein a nip portion formed between the pair of belts of the contact-heating fixing devise has a width of 10 to 55 mm.
3. The image forming method of Item 2, wherein the nip portion has a width of 15 to 40 mm.
4. The image forming method of any one of Items 1 to 3, wherein the pair of belts comprise a heating belt and a pressing belt, and each of the heating belt and the pressing belt is a seamless belt.
5. The image forming method of Item 4, wherein the heating belt has a 3-layer structure comprising:

a substrate comprising polyimide;

an elastic layer comprising silicone rubber formed on the substrate; and an outer surface layer which is a perfluoroalkoxy tube.

6. The image forming method of Item 4, wherein the heating belt has a 2-layer structure comprising:

a substrate comprising polyester, polyperfluoroalkyl vinyl ether, polyimide or polyetherimide; and a releasing layer covering the substrate, the releasing layer comprising a fluorine resin added with a conductive material.

7. The image forming method of any one of Items 4 to 6, wherein the pressing belt comprises:

a substrate comprising polyimide; and an elastic layer formed on the substrate, the elastic layer comprising silicone rubber.

8. The image forming method of any one of Items 1 to 7, wherein the first releasing agent component has a content of 70 to 95% by mass, based on the total mass of the first releasing agent component and the second releasing agent component.
9. The image forming method of any one of Items 1 to 8, wherein a ratio of a sum of tertiary carbon atoms and quaternary carbon atoms is 0.1 to 20% in total carbon atoms constituting the hydrocarbon having the branched chain structure.
10. The image forming method of any one of Items 1 to 9, wherein a ratio of a sum of tertiary carbon atoms and quaternary carbon atoms is 0.1 to 1.0% in total carbon atoms constituting the hydrocarbon having the branched chain structure.
11. The image forming method of any one of Items 1 to 10, wherein a ratio of a sum of tertiary carbon atoms and quaternary carbon atoms is 0.3 to 1.0% in total carbon atoms constituting the hydrocarbon having the branched chain structure.
12. The image forming method of any one of Items 1 to 11, wherein the hydrocarbon having a branched chain structure is a microcrystalline wax.
13. The image forming method of Item 12, wherein the microcrystalline wax has 30 to 60 carbon atoms, a weight-average molecular weight of 500 to 800 and a melting point of 60 to 90° C.
14. The image forming method of any one of Items 1 to 13, wherein a content of the release agent is 1 to 30% by mass based on a total mass of the toner.
15. The image forming method of any one of Items 1 to 14, wherein the toner comprises a colorant, and a content of the colorant is 1 to 30% by mass based on a total mass of the toner.
16. The image forming method of any one of Items 1 to 15, wherein the toner is produced via a coagulation/fusion process.
17. The image forming method of any one of Items 1 to 16, wherein the toner has a core/shell structure.

The image forming method of the present invention has excellent effects that even if high-speed print (for example, 40 sheets/minute) is executed at a low fixing temperature (for example, 120° C.), toner is fixed at sufficient fixing strength, and satisfactory print images free from belt-shaped or stripe-shaped image defects are obtained, and even if the print images are piled and preserved, prints cause only limited document offset.

The inventors analyzed the causes for causing belt-shaped or stripe-shaped image defects, thereby found that the release agent component adheres inside the apparatus and causes contamination of the charging electrode or contamination the exposure system. Originally, the boiling point of the release agent itself is very high, so that evaporation thereof has not been conventionally considered However, as the melting point of the release agent has been lowered to realize low-temperature fixing, the boiling point has also been lowered. As the result, it is deduced that the component of the release agent which easily evaporate at the temperature of the fixing device has increased, namely, the component of the releasing agent having a easily vaporizable structure has increased.

Namely, when forming an image by heat fixing using a toner using a low-melting point release agent, the low-melting point release agent itself contains a component comparatively volatile, so that a vaporizing component is generated by the heat in the inside of the apparatus. It was found that the vaporizing component adheres to the charging electrode of the charging means to cause irregular charging or adheres to the polygon mirror of the exposure system to cause stripe-shaped defects during exposure, thus image defects are formed.

This phenomenon occurs easily in a high-speed image forming apparatus equipped with a contact-heating fixing devise having a paired-belt constitution, which can receive evenly the fixing heat in the fixing nip section.

On the other hand, for low-temperature fixing, desired is a fixing device in which a wider nip section of a paired-belt constitution (for example, a heating belt and a pressing belt) is obtainable.

In the present invention, print images free from belt-shaped or stripe-shaped image defects, and exhibiting only limited document offset even when the print images are piled and preserved, have been obtained in combination of the following two points: (i) evaporation of the volatile component of the toner was suppressed by focusing on the structure of the low-melting point release agent; and (ii) a contact-heating fixing devise having a paired-belt construction (namely, having a pair of belts) was employed, the fixing devise exhibiting an excellent fixing efficiency Thus the present invention has been completed.

Further, the "document offset" used in the present invention refers to a phenomenon that when printed transfer materials are piled and stored, a toner image is transferred to the back of any transfer material or transfer materials are adhered to each other.

The reason why the problem of the fixing strength could be solved is deduced as follows: by employing the contact-heating fixing devise having a paired-belt constitution, a sufficient width of the fixing nip section was obtained and thus the toner on each transfer material could be sufficiently fused evenly and efficiently, even when the printing speed was increased, whereby a satisfactory fixing rate was attained even during low-temperature fixing.

The reason why an occurrence of belt-shaped or stripe-shaped image defects could be reduced is deduced as follows: since the toner containing a release agent having low volatile component was fixed at a low temperature, the amount of volatile component vaporized from the toner was reduced, and the contamination of the charging electrode or exposure system by the volatile component was also reduced.

Furthermore, the reason why the occurrence of the document offset could be prevented is deduced as follows: since the toner containing a release agent having low volatile component was fused and adhered onto the transfer material, the amount of vaporizing component bled out during the storage was reduced, thus the prevention of the document offset was attained.

Hereinafter, the present invention will be explained in more detail.

(Toner)

The toner of the present invention contains a binder resin, a colorant, and a release agent, and the release agent contains two or more kinds of release agent components at least including a first release agent component containing a monoester compound expressed by Formula (1) as shown below and a second release agent component containing a hydrocarbon including the branched chain structure. Further, in the first release agent component and second release agent component, the ratio of the first release agent component is 40 to 98 percent by mass and preferably 70 to 95 percent by mass.

$$R_1—COO—R_2 \qquad \text{Formula (1)}$$

In the Formula (1), $R_1$ and $R_2$ each represent a substituted or non-substituted hydrocarbon group with a main chain having 13-30 carbon atoms, and $R_1$ and $R_2$ may be the same or different.

The ratio of the first release agent component in the release agent is 40 percent by mass or more, thus due to the existence of the polar group in the monoester compound, the adhesion between the toner and the transfer material is enhanced in the overall area of the toner image, so that sufficient adhesion of the image can be maintained.

On the other hand, when the ratio of the first release agent component is more than 98 percent by mass, the releasing action between the heating belt and the transfer material due to the effect of the second release agent component described later, which is a non-polar release agent, cannot be fully obtained.

(First Release Agent Component)

In the aforementioned Formula (1) indicating the monoester compound which is the first release agent component composing the release agent, $R_1$ and $R_2$ each represent a hydrocarbon group having a carbon number of 13 to 30, preferably 17 to 22 of the main chain which may or may not have a substituent. $R_1$ and $R_2$ may be the same or different from each other.

Such a monoester compound has a low melting point and a structure that a vaporizing component tends not to generate. The reason is inferred that, since the monoester compound has a high with the hydrocarbon including the branched chain structure which is the second release agent component, it can be dispersed with high uniformity with the hydrocarbon including the branched chain structure.

In the present invention, since the release agent contains the first release agent component containing the monoester compound, so that the satisfactory adhesion to a transfer material is obtained, which cannot be obtained only by the hydrocarbon including the branched chain structure which is a non-polar compound. Thus, the toner can be surely fixed on the transfer material.

As a concrete example of the monoester compound represented by aforementioned. Formula (1), for example, the compounds expressed by the following formulas (a) to (h) can be illustrated.

$$CH_2—(CH_2)_{12}—COO—(CH_2)_{13}—CH_3 \qquad \text{Formula (a)}$$

$$CH_3—(CH_2)_{14}—COO—(CH_2)_{15}—CH_3 \qquad \text{Formula (b)}$$

$$CH_3—(CH_2)_{16}—COO—(CH_2)_{17}—CH_3 \qquad \text{Formula (c)}$$

$$CH_3—(CH_2)_{16}—COO—(CH_2)_{21}—CH_3 \qquad \text{Formula (d)}$$

$$CH_3—(CH_2)_{20}—COO—(CH_2)_{17}—CH_3 \qquad \text{Formula (e)}$$

$$CH_3—(CH_2)_{20}—COO—(CH_2)_{21}—CH_3 \qquad \text{Formula (f)}$$

$$CH_3—(CH_2)_{25}—COO—(CH_2)_{25}—CH_3 \qquad \text{Formula (g)}$$

$$CH_3—(CH_2)_{28}—COO—(CH_2)_{29}—CH_3 \qquad \text{Formula (h)}$$

In these monoester compounds, from the viewpoint of the low melting point, the groups $R_1$ and $R_2$ preferably have the straight-chain structure, however, the monoester compound may include a branched chain structure.

As a concrete example of the monoester compound including the branched chain structure, for example, the compounds represented by following Formulas (i) and (j) may be illustrated.

Formula (i)

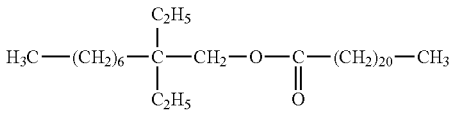

Formula (j)

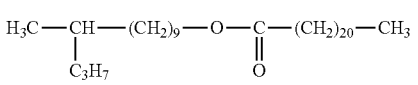

(Second Release Agent Component)

The second release agent component composing the release agent is a hydrocarbon including the branched chain structure which is the second release agent. The branching ratio of the hydrocarbon including the branched chain structure, that is, the ratio of the total of the tertiary carbon atoms and quaternary carbon atoms among all the carbon atoms composing the hydrocarbon including the branched chain structure is a value obtained by the following method, which is preferably 0.1 to 20%, more preferably 0.3 to 1.0%. The the second release agent component may be an admixture of a hydrocarbon having a branched chain structure and a hydrocarbon having no branched chain structure, namely, a straight chain hydrocarbon.

The content of the second release agent component of the release agent is 2 to 60 percent by mass and preferably 5 to 30 percent by mass based on the total mass of the release agent.

The ratio of the sum of the tertiary carbon atoms and quaternary carbon atoms among all the carbon atoms composing the hydrocarbon including the branched chain structure is within the range from 0.1 to 20%, so that the hydrocarbon including the branched chain structure tends not to generates a vaporizing component, while having a low melting point.

Further, the second non-polar release agent component has an effect for making the separation of the transfer material from the heating belt easier.

Concretely, the branching ratio of the hydrocarbon containing the branched chain structure is determined by Equation (2), using the spectrum obtained by the 13C-NMR measurement under the following condition.

$$\text{Branching ratio (\%)} = (C3+C4)/(C1+C2+C3+C4)\times 100 \quad \text{Equation (2)}$$

(In Equation (2) aforementioned, C3 indicates a peak area relating to the tertiary carbon atoms, C4 a peak area relating to the quaternary carbon atoms, C1 a peaks area relating to the primary carbon atoms, and C2 a peak area relating to the secondary carbon atoms.)

(Condition of 13C-NMR Measurement)

Measuring apparatus: FT NMR spectrometer Lambda 400 (produced by JEOL Ltd.)

Measuring frequency: 100.5 MHz

Pulse condition: 4.0 μs

Data point: 32768

Delay time: 1.8 sec

Frequency range: 27100 Hz

The number of integrating: 20000

Measurement temperature: 80° C.

Solvent: benzene-$d_6$/o-dichlorobenzene-$d_4$=1/4 (v/v)

Sample concentration: 3% by mass

Sample tube: ϕ5 mm

Measurement mode: 1H complete decoupling method.

Examples of a hydrocarbon having a branched chain structure include: microcrystalline waxes such as HNP-0190, Hi-Mic-1045, Hi-mic-1070, Hi-Mic-1080, Hi-Mic-1090, Hi-Mic-2045, Hi-Mic-2065 and Hi-Mic-2095 (produced by Nippon Seiro Co., Ltd.); and waxes mainly containing an isoparaffin wax, such as waxes EMW-0001 and EMW-0003.

Of these, HNP-0190 containing 0.1-20% of branched chain structure is preferable.

A microcrystalline wax which is one of petroleum waxes and differs from a paraffin wax which is mainly comprised of a straight chain hydrocarbon (normal paraffin), is a wax in which the proportion of branched chain hydrocarbons (isoparaffin) and cyclic hydrocarbons (cycloparaffin) is relatively high. Generally, a microcrystalline wax, which is mainly comprised of low-crystalline isoparaffin and cycloparaffin, is composed of smaller crystals and exhibits a larger molecular weight, compared to a paraffin wax. Such a microcrystalline wax has 30-60 carbon atoms, a weight-average molecular weight of 500-800 and a melting point of 60-90° C.

A microcrystalline wax with a weight average molecular weight of 600-800 and a melting point of 60-85° C. is preferable when the microcrystalline wax is employed in the present invention. Further, a paraffin wax having a number-average molecular weight of 300-1,000 (preferably 400-800) is preferred. The ratio of weight average molecular weight to number average molecular weight (Mw/Mn) is preferably from 1.01-1.20.

(Manufacturing Method of the Hydrocarbon Including the Branched Chain Structure)

As a manufacturing method for obtaining such a hydrocarbon including the branched chain structure, two methods may be cited such as the press perspiration method for separating and taking out hydrocarbon solidified in the state that stock oil is maintained at a specific temperature and the solvent extraction method for adding and crystallizing a solvent to stock oil which is vacuum distillation residual oil of petroleum or heavy distillate oil and filtering it, though the latter solvent extraction method is preferable. Further, the hydrocarbon including the branched chain structure obtained by the aforementioned manufacturing methods is colored, so that it may be refined using white soil sulfate.

As a second release agent composing the toner release agent relating to the present invention, a combination of two or more kinds of hydrocarbons including the branched chain structure can be used.

The content of the release agent of the toner relating to the present invention is preferably 1 to 30 percent by mass in toner, more preferably 5 to 20 percent by mass.

The melting point of overall the release agent composing the toner relating to the present invention is, for example, 60 to 100° C., preferably 65 to 85° C.

The melting point of the release agent composing the toner relating to the present invention indicates the temperature of the peak top at the release agent endothermic peak and can be measured, for example, by using "DSC-7 Differential Scanning Calorimeter" (manufactured by PerkinElmer Inc.) or "TAC7/DX Thermal Analyzer Controller" (manufactured by PerkinElmer Inc.).

Concretely, a release agent of 4.00 mg is weighed accurately down to the second decimal place, is charged into an aluminum pan (KITNO. 0219-0041), is set in a DSC-7 sample holder, is subject to the temperature control of Heat-Cool-Heat under the condition of a measuring temperature of 0° C. to 200° C., a temperature rising speed of 10° C./minute, and a temperature falling speed of 10° C./minute, and is analyzed on the basis of the data at the second Heat. For reference measurement, an empty aluminum pan is used.

(Manufacturing Method of Toner)

Methods of manufacturing the toner of the present invention are not specifically limited and examples thereof include a pulverization method, a suspension polymerization method, a mini-emulsion polymerization coagulation method, an emulsion polymerization coagulation method, a solution suspension method and a polyester molecule elongation method. Of these methods, the mini-emulsion polymerization coagulation method is specifically preferred, in which, in an aqueous medium containing a surfactant at a concentration lower than the critical micelle concentration, a polymerizable monomer solution containing a releasing agent dissolved in a polymerizable monomer is dispersed by employing mechanical energy to form oil droplets (10-1000 nm) to prepare a dispersion; to the prepared dispersion, a water-soluble polymerization initiator is added to perform radical polymerization to obtain binder resin particles; the obtained binder resin particles were coagulated (coagulated/fused) to obtain a toner.

In the foregoing method, polymerization is performed in the form of oil droplets so that in the individual toner particles, wax molecules are definitely enclosed in the binder resin. It is therefore supposed that generation of volatile components of the releasing agent is inhibited until subjected to fixing in a fixing device or heated. An amount of wax charged as raw material is steadily contained in the toner.

In the foregoing mini-emulsion polymerization coagulation method, an oil-soluble polymerization initiator may be added to the monomer solution, in place of or concurrently with addition of the water-soluble polymerization initiator.

In the method of manufacturing the toner of the present invention, binder resin particles formed in the mini-emulsion polymerization coagulation method may be formed of at least two layers, in which to a dispersion of first resin particles prepared by mini-polymerization according to the conventional manner (the first step polymerization), a polymerization initiator and a polymerizable monomer are added to perform polymerization (the second step polymerization).

To be more specific, the mini-emulsion polymerization coagulation method, as a manufacturing method of the toner comprises:

(1) dissolution/dispersion step in which toner particle constituent materials such as a releasing agent, a colorant and optionally, a charge control agent are dissolved or dispersed in a polymerizable monomer to form a binder resin to obtain a polymerizable monomer solution, (2) polymerization step in which the polymerizable monomer solution is dispersed in the form of oil-droplets dispersed in an aqueous medium and polymerized through mini-emulsion polymerization to prepare a dispersion of binder resin particles, (3) coagulation/fusion step in which the binder resin particles are allowed to be salted out, coagulated and fused to form coagulated particles, (4) ripening step in which the coagulated particles are thermally ripened to control the particle form to obtain a dispersion of toner particles, (5) cooling step in which the toner particle dispersion is cooled, (6) filtration/washing step in which toner particles are separated through solid/liquid separation from the cooled toner particle dispersion, and surfactants and the like are removed from the toner particles, (7) drying step in which the washed toner particles are dried, and (8) a step of adding external additives to the dried toner particles (external addition treatment).

The individual steps are further detailed below.

(1) Dissolution/Dispersion Step:

This step comprises dissolving or dispersing toner particle constituent materials such as releasing agents and colorants in a polymerizable monomer to form a polymerizable monomer solution.

The releasing agents are added in such an amount that the content of the releasing agents falls within the range described previously.

The polymerizable monomer solution may be added with an oil-soluble polymerization initiator and/or other oil-soluble components.

(2) Polymerization Step:

In one suitable embodiment of the polymerization step, the foregoing polymerizable monomer solution is added to an aqueous medium containing a surfactant at a concentration lower than the critical micelle concentration and mechanical energy is applied thereto to form oil-droplets, subsequently, polymerization is performed in the interior of the oil-droplets by radicals produced from a water-soluble polymerization initiator. Resin particles as nucleus particles may be added to the aqueous medium in advance.

Binder resin particles containing reducing agents and a binder resin are obtained in the polymerization step. The obtained binder resin particles may or may not be colored. The colored binder resin particles can be obtained by subjecting a monomer composition containing a colorant to polymerization. In cases when using nor-colored binder resin particles, a dispersion of colorant particles is added to a dispersion of binder resin particles, and the colorant particles and the binder resin particles are coagulated to obtain toner particles.

The aqueous medium refers to a medium that is composed mainly of water (at least 50% by mass). A component other than water is a water-soluble organic solvent. Examples thereof include methanol, ethanol, isopropanol, butanol, acetone, methyl ethyl ketone and tetrahydrofuran. Of these solvents, alcoholic organic solvents such as methanol, ethanol, isopropanol and butanol are specifically preferred.

Methods of dispersing a polymerizable monomer solution in an aqueous medium are not specifically limited but dispersion by using mechanical energy is preferred. Dispersing machines to perform dispersion by using mechanical energy are not specifically limited and examples thereof include CLEARMIX (produced by M Technique Co., Ltd.), an ultrasonic homogenizer, a mechanical homogenizer, a Manton-Gaulin homogenizer and a pressure homogenizer. The dispersed particle diameter is preferably within the range of 10-1000 nm, and more preferably 30-300 nm.

(3) Coagulation/Fusion Step:

In the coagulation/fusion step, in cases when the binder resin particles are non-colored, a dispersion of colorant particles is added to the dispersion of binder resin particles, obtained in the foregoing polymerization step, and allowing the binder resin particles to be salted out, coagulated and fused with the colorant particles. In the course of the coagulation/fusion step, binder resin particles differing in resin composition may further be added to perform coagulation.

In the coagulation/fusion step, particles of internal additives such as a charge control agent may be coagulated together with binder resin particles and colorant particles.

Coagulation/fusion is performed preferably in the following manner. To an aqueous medium including binder resin particle and colorant particles, a salting-out agent composed of alkali metal salts and/or alkaline earth metal salts is added as a coagulant at a concentration of more than the critical coagulation concentration and then heated at a temperature higher than the glass transition point of the binder resin particles and also higher than the melting peak temperature of a releasing agent used therein to perform salting-out concurrently with coagulation/fusion.

In the coagulation/fusion step, it is necessary to perform prompt rise in temperature by heating and the temperature raising rate is preferably at least 1° C./min. The upper limit of the temperature raising rate is not specifically limited but is preferably at most 15° C./min in terms of inhibiting formation of coarse particles due to a rapid progress of salting-out, coagulation and fusion.

After a dispersion of binder resin particles and colorant particles reaches a temperature higher than the glass transition point of the binder resin particles and also higher than the melting peak temperature of a releasing agent, it is essential to maintain that temperature of the dispersion over a given time to allow salting-out, coagulation and fusion. Thereby, growth of toner particles (coagulation of binder resin particles and colorant particles) and fusion (dissipation of interfaces between particles) effectively proceed, leading to enhanced durability of the toner.

A dispersion of colorant particles can be prepared by dispersing colorant particles in an aqueous medium. Dispersing colorant particle is performed at a surfactant concentration in water higher than the critical micelle concentration (CMC). Dispersing machines used for dispersing colorant particles are not specifically limited but preferred examples thereof include pressure dispersing machines such as an ultrasonic disperser, a mechanical homogenizer, a Manton-Gaulin homomixer or a pressure homogenizer, and a medium type dispersing machines such as a sand grinder, a Gettsman mil or a diamond fine mill.

The colorant particles may be those which have been subjected to surface modification treatments. Surface modification of the colorant particles is affected, for example, in the following manner. A colorant is dispersed in a solvent and thereto, a surface-modifying agent is added and allowed to react with heating. After completion of the reaction, the colorant is filtered off, washed with the same solvent and dried to produce surface-modified colorant particles.

(4) Ripening Step:

Ripening is performed preferably by using thermal energy (heating).

Specifically, a system including coagulated particles is stirred with heating, while controlling the heating temperature, a stirring speed and heating rate until the shape of toner particles reaches the intended average circularity.

In the ripening step, the toner particles obtained above may be used as core particles and binder resin particles are further attached and fused onto the core particles to form a core/shell structure. In that case, the glass transition point of binder resin particle constituting the shell layer is preferably higher by at least 20° C. than that of binder resin particles constituting the core particles.

When binder resin particles used in the coagulation/fusion step are composed of a resin made from a polymerizable monomer containing an tonically dissociative group (hydrophilic resin) and a resin made from a polymerizable monomer containing no ionically dissociative group (hydrophobic resin), toner particles having a core/shell structure may be formed by disposing the hydrophilic resin on the surface side of the coagulated particle and the hydrophobic resin in the inside of the coagulated particle.

(5) Cooling Step:

This step refers to a stage that subjects a dispersion of the foregoing toner particles to a cooling treatment (rapid cooling). Cooling is performed at a cooling rate of 1 to 20° C./min. The cooling treatment is not specifically limited and examples thereof include a method in which a refrigerant is introduced from the exterior of the reaction vessel to perform cooling and a method in which chilled water is directly supplied to the reaction system to perform cooling.

(6) Filtration/Washing Step:

In the filtration and washing step, a solid-liquid separation treatment of separating toner particles from a toner particle dispersion is conducted, then cooled to the prescribed temperature in the foregoing step and a washing treatment For removing adhered material such as a surfactant or salting-out agent from a separated toner particles (aggregate in a cake form) is applied.

In this step, washing is conducted until the Filtrate reaches a conductivity of 10 μS/cm. A filtration treatment is conducted, for example, by a centrifugal separation, filtration under reduced pressure using a Nutsche funnel or filtration using a filter press, but the treatment is not specifically limited.

(7) Drying Step:

In this step, the washed toner cake is subjected to a drying treatment to obtain dried colored particles Drying machines usable in this step include, for example, a spray dryer, a vacuum freeze-drying machine, or a vacuum dryer Preferably used are a standing plate type dryer, a movable plate type dryer, a fluidized-bed dryer, a rotary dryer or a stirring dryer. The moisture content of the dried toner particles is preferably not more than 5% by mass, and more preferably not more than 2%. When toner particles that were subjected to a drying treatment are aggregated via a weak attractive force between particles, the aggregate may be subjected to a pulverization treatment. Pulverization can be conducted using a mechanical pulverizing device such as a jet mill, Henschel mixer, coffee mill or food processor.

(8) External Additive Addition Step:

In this step, the dried colored particles are optionally mixed with external additives to prepare a toner. There are usable mechanical mixers such as a Henschel mixer and a coffee mill.

[Binder Resin]

Commonly known various resins, for example, vinyl resin such as styrene resin, (meth)acryl resin, styrene-(meth)acryl copolymer resin and olefinic resin, polyester resin, polyamide resin, polycarbonate resin, polyether resin, poly(vinyl acetate) resin, polysulfone resin, epoxy resin, polyurethane resin, and urea resin are used, as a binder resin constituting the toner of the present invention, in toner particles manufactured by a pulverization method or a solution suspension method. These resins can be used singly or in combination.

In the case of producing toner particles constituting toner of the present invention by a suspension polymerization method, a mini-emulsion polymerization-coagulation method, an emulsion-polymerization-coagulation method or such, examples of the polymerizable monomer to acquire each resin constituting the toner include vinyl based monomers of:

styrene or a styrene derivative such as styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-t-butylstyrene, p-n-hexylstyrene, p-n-octylstyrene, p-n-nonylstyrene, p-n-decylstyrene or p-n-dodecylstyrene;

a methacrylic acid ester derivative such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate or dimethylaminoethyl methacrylate;

an acrylic acid ester derivative such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate or phenyl acrylate;

olefin such as ethylene, propylene or isobutylene; vinyl halide such as vinyl chloride, vinylidene chloride, vinyl bromide, vinyl fluoride or vinylidene fluoride;

vinyl ester such as vinyl propionate, vinyl acetate or vinyl benzoate;

vinyl ether such as vinylmethyl ether or vinylethyl ether; vinyl ketone such as vinylmethyl ketone, vinylethyl ketone or vinylhexyl ketone;

a N-vinyl compound such as N-vinyl carbazole, N-vinyl indole or N-vinyl pyrrolidone; a vinyl compound such as vinyl naphthalene or vinyl pyridine; and an acrylic acid or a methacrylic acid derivative such as acrylonitrile, methacrylonitrile or acrylamide.

These vinyl based monomer are usable singly or in combination with at least two kinds.

Further, these are preferably used as a polymerizable monomer in combination with those having an ionic dissociation group. Polymerizable monomers having an ionic dissociation group are those having a substituent such as a carboxyl group, a sulfonate group or a phosphate group as a constituting group. Examples thereof include an acrylic acid, a methacrylic acid, a maleic acid, an itaconic acid, a cinnamic acid, a fumaric acid, maleic acid, monoalkylester, itaconic acid monoalkyl ester, styrene sulfonic acid, alylsulfo citric acid, 2-acrylamide-2-methylpropane sulfonic acid, acid phosphooxyethyl methacrylate and 3-chloro-2-acid phosphooxypropyl methacrylate.

In addition, a resin having a crosslinking structure can also be obtained by utilizing as a polymerizable monomer multifunctional vinyls such as divinylbenzene, ethyleneglycol dimethacrylate, ethyleneglycol diacrylate, diethylene glycol dimethacrylate, diethylene glycol diacrylate, triethylene glycol dimethacrylate, triethylene glycol diacrylate, neopentyl glycol dimethacrylate and neopentyl glycol diacrylate.

[Surfactant]

In manufacturing the toner particles of the present invention by the suspension polymerization method, a mini-emulsion polymerization coagulation method or emulsion polymerization coagulation method, surfactants used for obtaining a binder resin are not specifically limited but ionic surfactants described below are suitable. Such ionic surfactants include sulfates (e.g., sodium dodecylbenzenesulfate, sodium arylalkylpolyethersulfonate, sodium 3,3-disulfondisphenylurea-4,4-diazo-bis-amino-8-naphthol-6-sulfonate, ortho-carboxybenzene-azo-dimethylaniline, sodium 2,2,5,5-tetramethyl-triphenylmethane-4,4-diazo-bis-β-naphthol-6-sulfonate) and carboxylates (e.g., sodium oleate, sodium laurate, sodium caprate, sodium caprylate, sodium caproate, potassium stearate, calcium oleate). Nonionic surfactants are also usable. Examples thereof include polyethylene oxide, polypropylene oxide, a combination of polypropylene oxide and polyethylene oxide, an ester of polyethylene glycol and a higher fatty acid, alkylphenol polyethylene oxide, an ester of polypropylene oxide and a higher fatty acid, and sorbitan ester. These surfactants are used as an emulsifying agent when manufacturing the toner by an emulsion polymerization method but may also be used in other processes or for other purposes.

[Polymerization Initiator]

In manufacturing the toner particles of the present invention by the suspension polmerization method, a mini-emulsion polymerization coagulation method or an emulsion polymerization coagulation method, binder resin can be obtained through polymerization by using radical polymerization initiators.

Specifically, oil-soluble radical polymerization initiators are usable in suspension polymerization and examples of an oil-soluble polymerization initiator include azo- or diazo-type polymerization initiators, e.g., 2,2'-azobis-(2,4-dimethylvaleronitrile), 2,2'-azobisisobutylonitrile, 1,1'-azobis(cyclohexane-1-carbonitrile), 2,2'-azobis-4-methoxy-2,4-dimethylvaleronitrile, azobisisobutylonitrile; peroxide type polymerization initiators, e.g., benzoyl peroxide, methyl ethyl ketone peroxide, diisopropylperoxycarbonate, cumene hydroperoxide, t-butyl hyroperoxide, di-t-butyl peroxidedicumyl peroxide, 2,4-dichlorobenzoyl peroxide, lauroyl peroxide, 2,2-bis-(4,4-t-butylperoxycyclohexyl)-propane, tris-(t-butylperoxy)triazine; and polymeric initiators having a side-chain of peroxide.

Water-soluble radical polymerization initiators are usable in a mini-emulsion polymerization coagulation method or an emulsion polymerization coagulation method. Examples of a water-soluble polymerization initiator include persulfates such as potassium persulfate and ammonium persulfate, azobisaminodipropane acetic acid salt, azobiscyanovaleric acid and its salt, and hydrogen peroxide.

[Chain Transfer Agent]

In manufacturing the toner particles of the present invention by the suspension polymerization method, a mini-emulsion polymerization coagulation method or an emulsion polymerization coagulation method, generally used chain transfer agents are usable for the purpose of controlling the molecular weight of a binder resin.

Chain transfer agents are not specifically limited, but examples thereof include mercaptans such as n-octylmercaptan, n-decylmercaptane and tert-dodecylmercaptan; n-octyl-3-mercaptopropionic acid ester, terpinolene, carbon tetrabromide, carbon and α-methylstyrene dimmer.

[Colorant]

Commonly known inorganic or organic colorants are usable for the toner of the present invention. Specific colorants are as follows.

Examples of black colorants include carbon black such as Furnace Black, Channel Black, Acetylene Black, Thermal Black and Lamp Black and magnetic powder such as magnetite and ferrite.

Magenta and red colorants include C.I. Pigment Red. 2, C.I. Pigment Red 3, C.I. Pigment Red 5, C.I. Pigment Red 16, C.I. Pigment Red 48, C.I. Pigment Red 53, C.I. Pigment Red 57, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, and C.I. Pigment Red 222.

Orange or yellow colorants include C.I. Pigment Orange 31, C.I. Pigment Orange 43, C.I. Pigment Yellow 12, C.I. Pigment Yellow 13, C.I. Pigment Yellow 14, C.I. Pigment Yellow 15, C.I. Pigment Yellow 74, C.I. Pigment Yellow 93, C.I. Pigment Yellow 94, C.I. and Pigment Yellow 138.

Green or cyan colorants include C.I. Pigment Blue 15, C.I. Pigment Blue 15:2, C.I. Pigment Blue 15.3, C.I. Pigment Blue 15:4, C.I. Pigment Blue 16, C.I. Pigment Blue 60, C.I. Pigment Blue 62, C.I. Pigment Blue 66 and C.I. Pigment Green 7.

The foregoing colorants may be used singly or in combination with at least two kinds.

The colorant content is preferably 1-30% by mass, and more preferably 2-20% by mass based on the total mass of the toner.

Surface-modified colorants are also usable. Commonly known surface modifiers are usable and preferred examples thereof include a silane coupling agent, a titanium coupling agent and an aluminum coupling agent.

[Coagulant]

Coagulants usable in manufacturing the toner particles of the present invention by a mini-emulsion polymerization coagulation method or an emulsion polymerization coagulation method include, for example, alkali metal salts and alkaline earth metal salts. Alkali metals constituting a coagulant include, for example, lithium, sodium and potassium; alkaline earth metals constituting a coagulant include, for example, magnesium, calcium, strontium and barium. Of the foregoing, potassium, sodium, magnesium, calcium and barium are preferred. Counter-ions for the alkali metal or the alkaline earth metal (anion constituting a salt) include, for example, chloride ion, bromide ion, iodide ion, carbonate ion and sulfate ion.

[Charge Control Agent]

The toner particles of the present invention may optionally contain a charge control agent. Charge control agents usable in the present invention include various compound commonly known in the art.

[Toner Particle Diameter]

The toner particles of the present invention preferably have a number median particle diameter of 3-8 μm. In manufacturing toner particles by the polymerization methods described earlier, the particle diameter can be controlled by a coagulant concentration, the addition amount of organic solvents, a fusing time and polymer composition.

A number median particle diameter falling within the range of 3-8 μm not only achieves reproduction of fine lines and enhanced image quality of photographic images but can also reduce toner consumption, compared to the use of a toner of a larger particle diameter.

[Average Circularity of Toner Particle]

The toner particles of the present invention exhibit an average circularity of 0.930-1.000, and preferably an average circularity of 0.950-0.995 in view of improvement of a transfer efficiency. The average circularity is represented by the following equation (3).

Average circularity={(circumference of a circle having an area equivalent to the projected area of a particle)/(a circumference of the projected particle)} Equation (3)

[External Additives]

To improve flowability or charging property or to enhance cleaning capability, so-called external additives may be added to the toner of the present invention. External additives are not specifically limited, and a variety of inorganic particles, organic particles and lubricants are usable as an external additive.

Inorganic oxide particles of silica, titania, alumina and the like are preferably used for inorganic particles. The inorganic particles may be surface-treated preferably by using a silane coupling agent, titanium coupling agent and the like to enhance hydrophobicity. Spherical organic particles having an average primary particle diameter of 10-2000 nm are also usable. Polystyrene, poly(methyl methacrylate), styrene-methyl methacrylate copolymer and the like are usable as organic particles.

External additives are incorporated to the toner preferably in an amount of 0.1-5.0% by mass, and more preferably 0.5-4.0% by mass. External additives may be used in combination of with varieties of other additives.

[Developer]

The toner of the present invention may be used as a magnetic or nonmagnetic monocomponent developer or as a dicomponent developer together with a carrier. To be more concrete, in cases when the toner is used as a monocomponent developer, a nonmagnetic monocomponent developer and a magnetic monocomponent developer which contains magnetic particles of 0.1-0.5 μm in the toner are cited and both are usable. In cases when the toner is used as a dicomponent developer, magnetic particles composed of metals such as iron, ferrite or magnetite, or alloys of the foregoing metals and aluminum or lead are usable as a carrier, and of these, ferrite particles are specifically preferred. There may also be used a coat carrier of resin-coated magnetic particles and a resin dispersion type carrier in which a fine-powdery magnetic material is dispersed in a binder resin.

Coating resins used for the coat carrier are not specifically limited, and examples thereof include olefinic resin, styrene resin, styrene-acryl resin, silicone resin, ester resin and fluorine-containing polymer resin. Resins used for the resin dispersion type carrier are not specifically limited and commonly known ones are usable, such as styrene-acryl resin, polyester resin, fluororesin and phenol resin.

A coat carrier coated with styrene-acryl resin is cited as a preferred carrier in terms of preventing external additives from being released and durability.

The volume median diameter of carrier particles is preferably 20-100 μm, and more preferably 25-80 μm. The volume median diameter of the carrier particles can be determined using a laser diffraction type particle diameter distribution measurement apparatus provided with a wet disperser, HELOS (produced by SYMPATEC Corp.).

(Fixing Device)

The fixing device used in the image forming method of the present invention is a contact-heating fixing devise having a paired-belt constitution.

The contact-heating fixing devise can form a wide nip section by a pair of belts (for example, a heating belt and a pressing belt), so that a long period of time required for supplying heat necessary for fixing to toner and a transfer material can be taken and the fixing efficiency is excellent.

The structure of the fixing device of the contact heating system, if the pair of belts makes contact with each other and the nip section has a fixed width at the contact parts, is not restricted particularly. Further, the width of the nip section is set at a preferable width depending on the structure thereof.

FIGS. 1(*a*) to 1(*e*) are schematic diagrams showing examples of the fixing device of the contact heating system having a pair of belts.

In FIGS. 1(*a*) to 1(*e*), numeral 1 indicates a contact-heating fixing devise, 2 a heating belt, 3 a pressing belt, 4 a heat source, 5 tension rolls, 6 a press contact member having a heat source, 7 a drive roll, 8 press contact members, N a nip section, 9 a temperature detection section, P a transfer material, and T toner.

FIG. 1(*a*) shows a structure that by the tension rolls 5 and press contact members 8, the heating belt 2 is pressurized to the pressing belt 3 and by the heat source 4 built in the drive roll 7, the heating belt 2 is heated.

FIG. 1(*b*) shows a structure that by the tension rolls 5 and press contact members 8, the heating belt 2 is pressurized to the pressing belt 3 and the heating belt 2 is heated by the press contact member 6 having the heat source 4.

FIG. 1(*c*) shows a structure that the drive roll 7 of the pressing belt 3 shown in FIG. 1(*a*) also has the heat source 4 and it is heated by both the heating belt and pressing belt.

FIG. 1(*d*) shows a structure that the heating belt 2 is set in the state that it is shifted forward from the pressing belt 3 and is pressurized between the belts and the drive rolls 5 and by the heat source 4 built in the drive roll 7 of the heating belt 2, the heating belt 2 is heated.

FIG. 1(*e*) shows a structure that the heating belt 2 is set in the state that it is shifted backward from the pressing belt 3 and is pressurized between the belts and the drive rolls 5 and by the heat source 4 built in the drive roll 7 of the heating belt 2, the heating belt 2 is heated.

The contact-heating fixing devise shown in FIGS. 1(*a*), 1(*b*), or 1(*c*) is pressurized mainly by the press contact member.

On the other hand, the contact-heating fixing devises shown in FIGS. 1(*d*) and 1(*e*) are pressurized between the drive rolls of the heating belt, the drive rolls of the pressing belt, and the belts. The contact-heating fixing devises shown in FIGS. 1(*d*) and 1(*e*) do not need the press contact member, so that the apparatus can be made inexpensive and the belts are not rubbed by the press contact member, so that the life span of the belts can be lengthened preferably.

Furthermore, the contact-heating fixing devise shown in FIGS. 1(*d*) and 1(*e*), compared with the ones shown in FIGS.

1(*a*), 1(*b*), and 1(*c*), even if the press contact width of the nip section is spread, a transfer medium can be stably conveyed preferably.

Next, each belt composing a pair of belts will be explained.

According to the present invention, as a shape of the belts, it is preferable to use a seamless heating belt and a seamless pressing belt.

As a heating belt, one which is heat-resistant, flexible, and releasable from fused toner is used.

Concretely, (i) a heating belt having a 3-layer structure containing a silicone rubber elastic layer and a surface layer of a PFA (perfluoroalkoxy) tube provided on a polyimide substrate; and (ii) a heating belt of a 2-layer structure containing a substrate containing polyester, polyperfluoroalkyl vinyl ether, polyimide or polyetherimide and a releasing layer of a fluorine resin added with a conductive material coated on the substrate; may be cited.

As a pressing belt, since it is heated by the heating belt, one which is heat-resistant and conveys a support satisfactorily is suitable.

Concretely, a pressing belt having an elastic layer of silicone rubber installed on a polyimide base is preferable.

Figure 2:
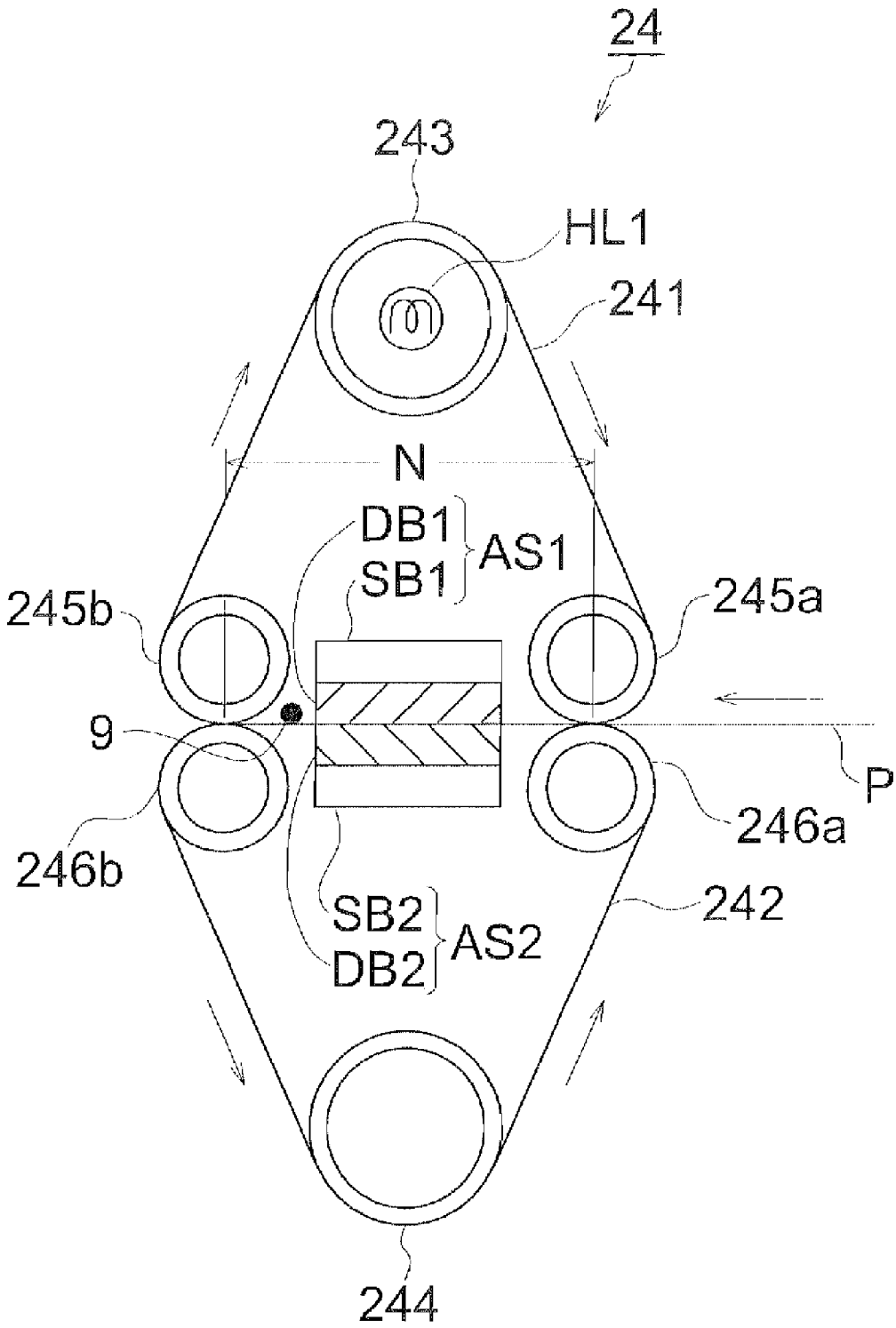
FIG. 2 is a schematic view of the contact-heating fixing devise shown in FIG. 1(*a*).

FIG. 2 is a schematic view of the contact-heating fixing devise shown in FIG. 1(*a*).

In FIG. 2, numeral 24 indicates a fixing device, 241 a heating belt, 242 a pressing belt, 243 a drive roller, 244 a drive roller, 245*a* and 245*b* tension rollers, 246*a* and 246*b* tension rollers, HL1 a heat source, and AS1 and AS2 press contact members.

The heating belt 241 is stretched by the drive roller 243 having the built-in heat source HL1 and tension rollers 245*a* and 245*b* and the pressing belt 242 is stretched by the drive roller 244 and tension rollers 246*a* and 246*b*.

The press contact member AS1 is made up of an elastic member DB1 and a support member SB1 for supporting the elastic member DB1 and the press contact member AS2 is made up of an elastic member DB2 and a support member AS2 for supporting the elastic member DB2. As the elastic members DB1 and DB2, heat-insulating silicone rubber is used preferably. For the support members SB1 and SB2, a metallic plate and heat-resistant resin are used preferably.

The tension roller 245*a* is in contact with the tension roller 246*a* across the heating belt 241 and pressing belt 242 and the tension roller 245*b* is in contact with the tension roller 246*b* across the heating belt 241 and pressing belt 242. The tension rollers 245*a* and 245*b* and the tension rollers 246*a* and 246*b* make contact with each other, thus the heating belt 241 and the pressing belt 242 make contact with each other and the nip section N is formed.

In this embodiment, the press contact members AS1 and AS2 are arranged generally away from each other and in accordance with entry of the transfer material P with a toner image transferred into the nip section N, by an instruction of a control means not drawn, are pressurized by a well-known cam means not drawn. However, a constitution that a low-friction layer is formed on the surfaces of the press contact members and they make contact always with the heating belt 241 and pressing belt 242 may be realized.

The elastic member DB1 of the press contact member AS1, at the nip section N, is pressurized by the elastic member DB2 of the press contact member AS2 across the heating belt 241 and pressing belt 242.

When fixing the transfer material P with a toner image transferred on the surface thereof, the drive roller 243 is heated by the heat source HL1 and the heating belt 241 is heated to a predetermined temperature. When the transfer material P enters the nip section N between the heating belt and the pressing belt, it is transferred with heat from the heated heating belt 241 and passes through the press contact portion (no reference numeral given) between the press contact members AS1 and AS2 having the elastic members DB1 and DB1, thus the transfer material P is heated and fixed. Further, the temperature of the heating belt 241 is detected by the temperature detector 9 and is controlled to a predetermined temperature.

The width of the nip section is preferably 10 to 55 mm, more preferably 15 to 40 mm. When the width of the nip section is narrow, heat cannot be given to toner uniformly, causing irregular fixing. On the other hand, when the width of the nip section is wide, fusion of resin is promoted, thus a problem arises that the fixing offset is increased.

The heating belt may be equipped with a cleaning mechanism for fixing device as this system, a system of fixing silicone oil and then supplying it to a roll or a film; or a method for cleaning with a pad, a roll, or a web which are impregnated with silicone oil; can be used.

(Image Forming Method)

In the present invention, a toner image is formed according to the following steps via an electrophotographic method:

(i) charging a surface of a photoreceptor;

(ii) exposing the charged photoreceptor to form an electrostatic latent image;

(iii) developing the electrostatic latent image using a toner comprising at least a release agent to form a toner image;

(iv) transferring the toner image on the photoreceptor to a transfer material; and (v) fixing the toner image transferred on the transfer material employing a contact-heating fixing devise comprising a pair of belts.

Further, the above step (iv) preferably has the following steps:

(iv-1) transferring the toner image formed on the photoreceptor onto an intermediate transfer medium (a first transfer); and (iv-2) transferring the toner image formed on the intermediate transfer medium onto a transfer material (a second transfer).

More details of the image forming method will be described below with the image forming apparatus.

(Image Forming Apparatus)

Next, the image forming apparatus will be explained.

The image forming apparatus used in the present invention includes preferably at least a charging means for charging the surface of a photoreceptor, an exposure means for exposing the charged photoreceptor and forming an electrostatic latent image, a developing means for developing the electrostatic latent image on the photoreceptor with toner and forming a toner image, a primary transfer means for transferring the toner image on the photoreceptor onto an intermediate transfer medium, a transfer means for transferring the toner image transferred onto the intermediate transfer medium to a transfer material, and a means for heat-fixing the toner on the transfer material on the transfer material using a contact-heating fixing devise made up of a heating belt and a pressing belt.

Further, the image forming apparatus, in addition to the means aforementioned, is equipped preferably with a cleaning means for cleaning the intermediate transfer medium and a means for coating a lubricant on the surface of the photoreceptor.

Figure 3:
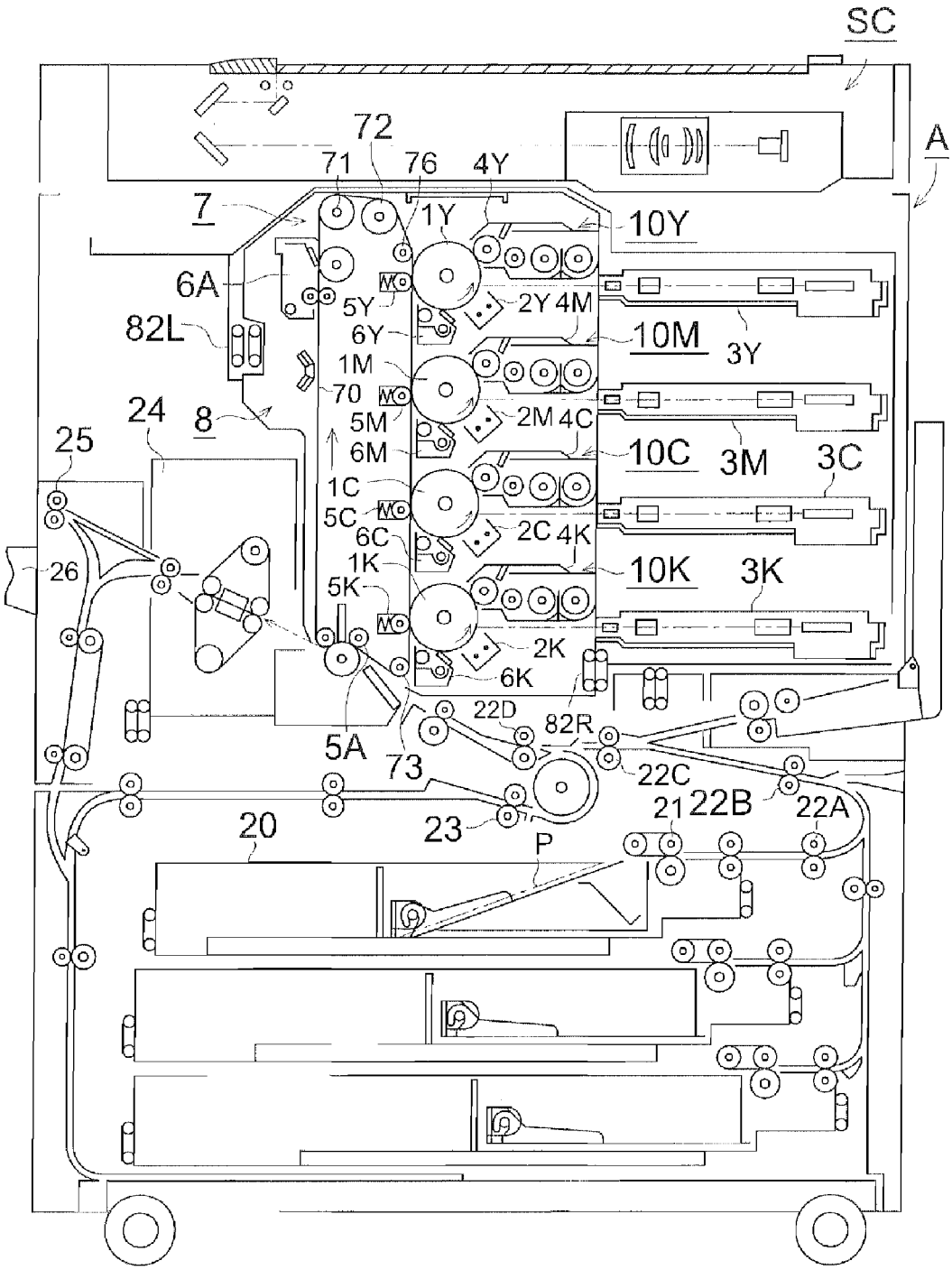
FIG. 3 is a cross sectional constitution diagram showing an example of the image forming apparatus used in the present invention.

FIG. 3 is a cross sectional constitution diagram showing an example of the image forming apparatus used in the present invention.

This image forming apparatus is a so called tandem type color image forming apparatus, and contains four sets of image forming sections (image forming units) 10Y, 10M, 10C, and 10K, endless belt shaped intermediate image transfer unit 7, endless belt shaped sheet feeding and transportation device 21 which transports transfer material P, and contact-heating fixing devise 24. The original document reading apparatus SC is placed on the top of main unit A of the image forming apparatus.

Image forming section 10Y that forms an image of yellow color as one of the toner images having different colors on each photoreceptors contains drum shaped photoreceptor 1Y as a first image carrier, together with: charging device 2Y, exposing device 3Y, developing device 4Y, primary transfer roller 5Y as primary transfer section, and cleaning means 6Y, which are placed around photoreceptor 1Y. Image forming section 10M that forms an image of magenta color as one of the toner images having different colors on each photoreceptors contains drum shaped photoreceptor 1M as a first image carrier, together with: charging device 2M, exposing device 3M, developing device 4M, primary transfer roller 5M as primary transfer section, and cleaning means 6Y, which are placed around photoreceptor 1M. Image forming section 10C that forms an image of cyan color as one of the toner images having different colors on each photoreceptors contains drum shaped photoreceptor 1C as a first image carrier, together with: charging device 2C, exposing device 3C, developing device 4C, primary transfer roller 5C as primary transfer section, and cleaning means 6C, which are placed around photoreceptor 1C. Image forming section 10K that forms an image of black color as one of the toner images having different colors on each photoreceptors contains drum shaped photoreceptor 1K as a first image carrier, together with: charging device 2K, exposing device 3K, developing device 4K, primary transfer roller 5K as primary transfer section, and cleaning means 6K, which are placed around photoreceptor 1K.

Intermediate image transfer body unit 7 in the shape of an endless belt is wound around a plurality of rollers, and has endless belt shaped intermediate image transfer body 70 (transfer medium) which acts as the second image carrier in the shape of a semiconducting endless belt which is supported to be able to freely rotate.

The images of different colors formed by image forming units 10Y, 10M, 10C and 10K, are successively transferred onto rotating endless belt shaped intermediate image transfer body 70 by primary transfer rollers 5Y, 5M, 5C, and 5K acting as the primary image transfer section, thereby forming the synthesized color image. Transfer material P (for example, a paper sheet) as the transfer material stored inside sheet feeding cassette 20 is fed from sheet feeding-transporting device 21, pass through a plurality of intermediate rollers 22A, 22B, 22C, and 22D, and resist roller 23, and is transported to secondary transfer roller 5A which functions as the secondary image transfer section, and the color image is transferred in one operation of secondary image transfer on to transfer material P. Transfer material P on which the color image has been transferred is subjected to fixing process by contact-heating fixing devise 24 having a heating belt and a pressing belt, and is gripped by sheet discharge rollers 25 and placed above sheet discharge tray 26 outside the equipment.

On the other hand, after the color image is transferred to transfer material P by secondary transfer roller 5A, endless belt shaped intermediate image transfer body 70 from which transfer material P has been separated due to different radii of curvature is cleaned by cleaning device 6A to remove residual toner on it.

During image forming, primary transfer roller 5K is always contacting against photoreceptor 1K. Other primary transfer rollers 5Y, 5M, and 5C come into contact with corresponding photoreceptors 1Y, 1M, and 1C, respectively only during color image forming.

Secondary transfer roller 5A comes into contact with endless belt shaped intermediate transfer body 70 only when transfer material P passes through it to carry out the secondary transfer.

Further, chassis 8 is made so as to be able to be pulled out from main body A of the apparatus via supporting rails 82L and 82R.

Chassis 8 contains image forming sections 10Y, 10M, 10C, and 10K, and endless belt shaped intermediate image transfer body unit 7.

Image forming sections 10Y, 10M, 10C, and 10K are arranged in column in the vertical direction. Endless belt shaped intermediate image transfer body unit 7 is placed to the left side in the figure of photoreceptors 1Y, 1M, 1C, and 1K. Endless belt shaped intermediate image transfer body unit 7 contains endless belt shaped intermediate image transfer body 70 that can rotate around rollers 71, 72, 73, and 76, primary image transfer rollers 5Y, 5M, 5C, and 5K, and cleaning means 6A.

By pulling out chassis 8, image forming sections 10Y, 10M, 10C, and 10K and endless belt shaped intermediate image transfer body unit 7 are pulled out together from main body A.

Thus, a toner image is formed by: charging, light exposing, and developing on photorecepters 1Y, 1M, and 1C and 1K; piling up the toner images of each color on endless belt shaped intermediate image transfer body 70; transferring the image on transfer material P in a lump; and fixing by heating and pressing using the heating belt and the pressing belt. After transferring a toner image to the transfer material P, photorecepters 1Y, 1M, 1C, and 1K are subjected to cleaning to remove the toner left on the photoreceptors using cleaning means 6. Then, new cycle of above-mentioned charging, light exposure, and developing is started to form a next image.

EXAMPLES

The present invention is specifically explained using examples below, however the embodiment of the present invention is not limited thereto <<Preparation of Toner>>

The toner was prepared by the following procedure.

<Preparation of Releasing Agent>

In Table 1, components, materials, carbon numbers ($R_1$-$R_2$), ratios of branched chain of hydrocarbons, melting points and molecular weights of the prepared releasing agents are listed. Releasing agents 7-10 were obtained by separation from a raw oil which was a residual dross of petroleum after reduced-pressure distillation or a heavy distillate oil, via a solvent extraction method.

TABLE 1

| Releasing Agent No. | Component of releasing agent | Material | Carbon Number ($R_1$-$R_2$) | Ratio of branched chain of hydrocarbon | Melting Point | Molecular weight |
|---|---|---|---|---|---|---|
| 1 | Monoester compound | Formula (a) | 13-14 | — | 41 | — |
| 2 | Monoester compound | Formula (c) | 17-18 | — | 58 | — |

TABLE 1-continued

| Releasing Agent No. | Component of releasing agent | Material | Carbon Number ($R_1$-$R_2$) | Ratio of branched chain of hydrocarbon | Melting Point | Molecular weight |
|---|---|---|---|---|---|---|
| 3 | Monoester compound | Formula (f) | 21-22 | — | 71 | — |
| 4 | Monoester compound | Formula (h) | 29-30 | — | 92 | — |
| 7 | Hydrocarbon | — | — | 0.1 | 75 | 700 |
| 8 | Hydrocarbon | — | — | 0.3 | 80.2 | 640 |
| 9 | Hydrocarbon | — | — | 0.4 | 80 | 600 |
| 10 | Hydrocarbon | — | — | 1 | 81 | 550 |
| 11 | Monester compound | Laccerate ester | 31-2 | — | 76 | — |
| 12 | Monoester compound | Laurate ester | 11-12 | — | 27 | — |

M.P.: Melting point

<Preparation of Toner 1>

[Preparation of Resin Particle Dispersion 1]

(First Polymerization Step)

In a reaction vessel equipped with a stirrer, a temperature sensor, a condenser and a nitrogen gas introducing device, a solution of 8 mass parts of sodium dodecylsulfate dissolved in 3000 mass parts of ion-exchange water was charged and the internal temperature was raised to 80° C., while stirring at a stirring speed of 230 rpm under a nitrogen gas stream. After raised to the said temperature, a solution of 10 mass parts of potassium persulfate dissolved in 200 mass parts of ion-exchange water was added, then, the liquid temperature was raised again to 80° C. and a polymerizable monomer solution composed of 480 mass parts of styrene, 250 mass parts of n-butylacrylate, 68.0 mass parts of methacrylic acid and 16.0 mass parts of n-octyl-3-mercaptopropionate was dropwise added thereto over a period of 1 hr. After completion of addition, the reaction mixture was heated at 80° C. for 2 hr while stirring to perform polymerization to prepare a resin particle dispersion (1H) containing resin particles (1 h).

(Second Polymerization Step)

In a reaction vessel equipped with a stirrer, a temperature sensor, a condenser and a nitrogen gas introducing device, a solution of 7 mass parts of sodium polyoxyethylene-2-dodecyl ether sulfate dissolved in 800 mass parts of ion-exchange water was charged. After the internal temperature was raised to 98° C., a polymerizable monomer solution in which 260 mass parts of the foregoing resin particle dispersion (1H), 245 mass parts of styrene, 120 mass parts of n-butyl acrylate, 1.5 mass parts of n-octyl-3-mercaptopropionate, 64 mass parts of releasing agent 1 and 96 mass parts of releasing agent 7, both shown in Table 1, were dissolved at 90° C., was added thereto and mixed with stirring for 1 hr using a mechanical stirring machine having a circulation route, namely CLEARMIX (produced by M Technique Co., Ltd.) to prepare a dispersion containing emulsified particles (oil droplets).

Subsequently, to this dispersion added was an initiator solution of 6 mass parts of potassium persulfate dissolved in 200 mass parts of ion-exchange water and this system was heated at 82° C. while stirring over 1 hr. to perform polymerization, whereby resin particle dispersion (1HM) containing resin particles (1hm) was obtained.

(Third Polymerization Step)

To the foregoing resin particle dispersion (1HM) added was a solution of 11 mass parts of potassium persulfate dissolved in 400 mass parts of ion-exchange water, and a polymerizable monomer solution containing 435 mass parts of styrene, 130 mass parts of n-butyl acrylate, 33 mass parts of methacrylic acid and 8 mass parts of n-octyl-3-mercaptopropionate was dropwise added over a period of 1 hr. at 82° C. After completion of addition, stirring was continued with heating for 2 hr. to perform polymerization. Thereafter, the reaction mixture was cooled to 28° C. to obtain resin particle dispersion A containing resin particle "a". The particle diameter of the resin particle "a" of resin particle dispersion. A was measured using electrophoresis light scattering photometer ELS-800 (produced by OTSUKA DENSHI CO.) and the volume median diameter was determined to be 150 nm. Further, the glass transition temperature of resin particle "a" was 45° C.

[Preparation of Colorant Particle Dispersion Q]

While stirring a solution of 90 mass parts of sodium dodecyl sulfate dissolved in 1600 ml of ion-exchange water, 420 mass parts of C.I. Pigment Blue 15; 3 was gradually added and dispersed with CLEARMIX (produced by M Technique Co., Ltd.) to obtain colorant particle dispersion Q. The volume median diameter of the colorant particles in colorant particle dispersion Q was determined to be 110 nm using electrophoresis light scattering photometer ELS-800 (produced by OTSUKA DENSHI CO.).

[Preparation of Toner Particle 1]

Into a reaction vessel equipped with a stirrer, a temperature sensor, a condenser and a nitrogen gas introducing device, charged were resin particle dispersion A at a solid content of 300 mass parts, 1400 mass parts of ion-exchange water, 120 mass parts of colorant particle dispersion Q and a solution of 3 mass parts of sodium polyoxyethylene-2-dodecyl ether sulfate dissolved in 120 mass parts of ion-exchange water, and after adjusting the liquid temperature at 30° C., the pH was adjusted by adding a 5 N aqueous sodium hydroxide solution. Subsequently, an aqueous solution of 35 mass parts of magnesium chloride dissolved in 35 mass parts of ion-exchange water was added thereto at 30° C. for over 10 min. with stirring After being maintained for 3 min., the temperature was raised to 90° C. in 60 min. and maintained at 90° C. to promote particle growth reaction. While measuring coagulated particle diameters using Coulter Multicizer III and when the intended particle diameter was attained, an aqueous solution of 150 mass parts of sodium chloride dissolved in 600 mass parts of ion-exchange water was added threreto to terminate particle growth. Further, ripening was performed at 98° C. with stirring to promote fusion between particles until reached an average circularity of 0.965 which was measured by FPIA-2100 (produced by SYSMEX CORP.), allowing hydrophobic resin to orient toward the surface side of the coagulated particles and hydrophilic resin to orient toward the interior side of the coagulated particles to form toner particles having a core/shell structure. Then, cooling was conducted until reached 30° C. and the pH was adjusted to 4.0 with hydrochloric acid and stirring was terminated.

Thus formed toner particles were subjected to solid/liquid separation by using a basket type centrifugal separator, MARK III type No. 60x40 (produced by Matsumoto Kikai Co., Ltd.) to form a wet cake of the toner particles. The wet cake was washed with 45° C. ion-exchange water by using the basket type centrifugal separator until the filtrate exhibited an electric conductivity of 5 μS/cm, transferred to Flash Jet Dryer (produced by Seishin Enterprise Co., Ltd.) and dried until reached a moisture content of 0.5% by mass to obtain toner particle 1.

To resulting toner particle 1, 1% of hydrophobic silica (number average primary particle diameter of 12 nm) and 0.3% of hydrophobic titania (number average primary particle diameter of 20 nm) were added and mixed in a Henschel mixer to prepare toner 1.

The toner particle 1 was not varied by addition of hydrophobic silica or hydrophilic titanium oxide, with respect to shape or particle diameter.

[Preparation of Toners 2-8]

Each of toners 2-8 was prepared in the same manner as the preparation of toner 1, except that the types and the amounts of the first release agent component, and the types and the amounts of the second were changed as shown in Table 2.

Table 2 shows the release agent No. of the first release agent component of each toner prepared as indicated above, the ratio thereof, the release agent No. of the second release agent component, the ratio thereof, and the release agent addition quantity.

TABLE 2

| | First release agent component (Monoester compound) | | Second release agent component (Hydrocarbon) | | Release agent addition |
|---|---|---|---|---|---|
| Toner No. | Release agent No. | Ratio (percent by mass) | Release agent No. | Ratio (percent by mass) | quantity (percent by mass) |
| 1 | 1 | 40 | 7 | 60 | 15 |
| 2 | 2 | 90 | 8 | 10 | 15 |
| 3 | 3 | 80 | 9 | 20 | 15 |
| 4 | 4 | 98 | 10 | 2 | 15 |
| 5 | 3 | 100 | — | 0 | 15 |
| 6 | 3 | 30 | 8 | 70 | 17 |
| 7 | 11 | 80 | 7 | 20 | 17 |
| 8 | 12 | 80 | 7 | 20 | 15 |

(Preparation of Developers 1-8)

Ferrite carriers with silicone resin coated having a volume median diameter of 60 μm was mixed with each of toner Nos. 1 to 8 so as to obtain a toner concentration of 6 percent by mass, thus "developers 1 to 8" were obtained.

Properties concerning the fixing device are also described below.

Heating source:
Halogen heater lamp
Rated electric power: 600 W
Heating belt:
Width: 320 mm
Substrate:
Material: polyimide
Thickness: 75 μm
Elastic layer:
Material: silicone rubber
Thickness: 500 μm
Surface layer:
Material: PFA (perfluoroalkoxy)
Thickness: 30 μm
Pressing belt:
Width: 320 mm
Substrate:
Material: polyimide
Thickness: 75 μm
Elastic layer:
Material: silicone rubber
Thickness: 500 μm (Evaluation)

As an image forming apparatus for evaluation, the image forming apparatuses that the contact-heating fixing devises shown in FIGS. 1(*a*) and 1(*d*) were mounted on "bizhub PRO C650 (by Konica Minolta Business Technologies, Inc.) were prepared. Further, in the contact-heating fixing devise shown in FIG. 1(*a*), the nip width was set at 20 mm and in the contact-heating fixing devise shown in FIG. 1(*d*), the nip width was set at 25 mm.

For image evaluation of "Comparative Example 5", a comparison fixing device (a contact-heating fixing devise in which a heating belt was arranged on the upper side which was the unfixed toner image side and a pressing roller was arranged on the lower side (the width of the nip section was set at 10 mm)) and for image evaluation of "Comparative Example 6", a comparison fixing device (a contact-heating fixing devise in which a heating roller was arranged on the upper side which was the unfixed toner image side and a pressing roller was arranged on the lower side (the width of the nip section was set at 5 mm)).

The image formation is executed by loading sequentially the toners and developers prepared as mentioned above in the image forming apparatuses with the aforementioned contact-heating fixing devises mounted and using transfer sheets "J paper" (a basis weight of 64 g/m$^2$) (by Konica Minolta Business Technologies, Inc.) in the environment of normal temperature and normal humidity (20° C., 55% RH).

In "Comparative Example 5", in the image forming apparatuses with the contact-heating fixing devises mounted in which a heating belt was arranged on the upper side which is the unfixed toner image side and a pressing roller was arranged on the lower side, Toner 1 and Developer 1 prepared as mentioned above were loaded and the image formation was executed under the same condition as the aforementioned.

In "Comparative Example 6", in the image forming apparatuses with the contact-heating fixing devises mounted in which a heating roller was arranged on the upper side which is the unfixed toner image side and a pressing roller was arranged on the lower side, Toner 1 and Developer 1 prepared as mentioned above were loaded and the image formation was executed under the same condition as the aforementioned.

The following items were evaluated.

(Image Defects)

Under the condition of a temperature of 120° C., 140° C., or 160° C. of the heating belt of the contact-heating fixing devise, 10000 test image sheets each having: (i) a character image at a ratio of occupying image in printing area of 7%; (ii) a personal face photograph image; and (iii) a cyan half-tone image at a relative image density of 0.6 in each ⅓ of the test image sheet were printed.

Regarding image defects, for the 10000th printed image, the degree of belt-shaped or white stripe-shaped defects was evaluated visually.

(Evaluation Standard)

A: The cyan half-tone image portion at a relative image density of 0.6 is free from belt-shaped and white stripe-shaped defects; excellent.

B: The cyan half-tone image portion at a relative image density of 0.6 shows a slight white stripe-shaped defect, though it is preferable.

C: The cyan half-tone image portion at a relative image density of 0.6 shows several white stripe-shaped defects, though the character image and personal face photograph image show no conspicuous defects, thus it is practically acceptable.

D: The cyan half-tone image portion at a relative image density of 0.6 shows clear white stripes and it is not practically acceptable.

(Fixing Property)

The temperature of the heating belt is set at 120° C., 140° C., or 160° C., and a solid cyan document is printed, thus printed images are obtained.

The fixing strength of the obtained printed images is calculated and evaluated by the following method.

Further, for measurement of the image density, a reflection densitometer RD-918 (by Macbeth, Co., Ltd.) is used.

R4: Satisfactory level that in the image portions and non-image portions, image defects and transfer of the images are not seen.

Table 3 shows the evaluation results.

TABLE 3

| | | | Evaluation results | | | | | | |
|---|---|---|---|---|---|---|---|---|---|
| | | | 120° C. | | 140° C. | | 160° C. | | Document |
| | Fixing device | Toner No. | Image defects | Fixing property | Image defects | Fixing property | Image defects | Fixing property | offset property |
| Example 1 | *1 | 1 | A | B | A | B | B | B | R3 |
| Example 2 | *2 | 2 | A | B | A | B | B | A | R4 |
| Example 3 | *2 | 3 | A | A | A | A | A | A | R4 |
| Example 4 | *2 | 4 | A | A | A | A | A | A | R3 |
| Comp. 1 | *1 | 5 | B | B | C | B | C | B | R1 |
| Comp. 2 | *2 | 6 | B | C | B | C | B | B | R2 |
| Comp. 3 | *2 | 7 | B | B | C | B | C | B | R3 |
| Comp. 4 | *1 | 8 | B | B | C | B | C | B | R2 |
| Comp. 5 | *3 | 1 | A | C | A | B | B | B | R1 |
| Comp. 6 | *4 | 1 | A | C | A | C | A | B | R1 |

*1: Contact heating-fixing device described in FIG. 1(a) (Contact heating-fixing device in which the heating belt and pressing belt are arranged)
*2: Contact heating-fixing device described in FIG. 1(d) (Contact heating-fixing device in which the heating belt and pressing belt are arranged)
*3: Fixing device for comparison (Contact heating-fixing device in which the heating belt is arranged on the upper side which is the unfixed toner image side and the pressing roller is arranged on the lower side)
*4: Fixing device for comparison (Contact heating-fixing device in which the heating roller is arranged on the upper side which is the unfixed toner image side and the pressing roller is arranged on the lower side),
Comp.: Comparative example (Tape Peeling Method)

(1) An absolute reflection density D0 of a solid cyan document of a square of 5 mm is measured.

(2) A "Mending tape" (equivalent to No. 810-3-12 by Sumitomo 3M Limited) is applied slightly.

(3) The tape is rubbed back and forth 3.5 times at a pressure of 1 kPa.

(4) The tape is peeled off at an angle of 180° and at a force of 200 g.

(5) An absolute reflection density D1 after peeling is measured.

(6) Fixing strength=100×D1/D0(%)

(Evaluation Standard)

A: The fixing strength is 95% or more; excellent.

B: The fixing strength y is 90% or more and less than 95% and it is practically acceptable.

C: The fixing strength is less than 90% and it is not practically acceptable.

(Document Offset Property)

The document offset property is evaluated by setting the temperature of the heating belt at 140° C.; overlaying two printed images obtained by printing the same test image sheet as aforementioned so as to permit the image surface (printed surface) and non-image surface (back) to face each other; placing them on a glass plate; putting a weight equivalent to 7.8 kPa on them; leaving them in an environment of 60° C. and 50% RH for a week; and then peeling the two overlaid sheets. The degree of image defects of the peeled printed images were visually examined and ranked at the four stages of R1 to R4 indicated below. Ranks R3 and R4 were evaluated as practically acceptable.

R1: Level that the two sheets are adhered and hardly peeled off.

R2: Level that when the two sheets are peeled off, the image is transferred onto the back.

R3: Permissible level that although a reduction in the gloss of the image portions is observed, as images, there are very few image defects (transfer of the image to the back).

As clearly shown in Table 3, in the image formation of Examples 1 to 4 executed using the toner relating the present invention and the fixing device relating to the present invention, the evaluation of image defects, fixing strength, and document offset provided no trouble.

On the other hand, in the image formation of Comparative Examples 1 to 6 using the comparison toner and comparison fixing device, any of the evaluation items had a problem and the object of the present invention could not be accomplished.

What is claimed is:

1. An image forming method comprising the steps of:

(i) charging a surface of a photoreceptor;

(ii) exposing the charged photoreceptor to form an electrostatic latent image;

(iii) developing the electrostatic latent image using a toner comprising at least a release agent to form a toner image;

(iv) transferring the toner image on the photoreceptor to a transfer material; and (v) fixing the toner image transferred on the transfer material employing a contact-heating fixing devise comprising a pair of belts, wherein the releasing agent comprises a first release agent component containing a monoester compound represented by Formula (1) and a second release agent component containing a hydrocarbon having a branched chain structure, wherein a content of the first release agent is 40 to 98% by mass, based on a total mass of the first release agent component and the second release agent component:

$$R_1—COO—R_2 \qquad \text{Formula (1)}$$

wherein $R_1$ and $R_2$ each represent a substituted or non-substituted hydrocarbon group with a main chain having 13-30 carbon atoms, and $R_1$ and $R_2$ may be the same or different.

2. The image forming method of claim 1,
wherein a nip portion formed between the pair of belts of the contact-heating fixing devise has a width of 10 to 55 mm.

3. The image forming method of claim 2,
wherein the nip portion has a width of 15 to 40 mm.

4. The image forming method of claim 1,
wherein the pair of belts comprise a heating belt and a pressing belt, and each of the heating belt and the pressing belt is a seamless belt.

5. The image forming method of claim 4,
wherein the heating belt has a 3-layer structure comprising:
a substrate comprising polyimide;
an elastic layer comprising silicone rubber formed on the substrate; and
an outer surface layer which is a perfluoroalkoxy tube.

6. The image forming method of claim 4,
wherein the heating belt has a 2-layer structure comprising:
a substrate comprising polyester, polyperfluoroalkyl vinyl ether, polyimide or polyetherimide; and
a releasing layer covering the substrate, the releasing layer comprising a fluorine resin added with a conductive material.

7. The image forming method of claim 4,
wherein the pressing belt comprises:
a substrate comprising polyimide; and
an elastic layer formed on the substrate, the elastic layer comprising silicone rubber.

8. The image forming method of claim 1,
wherein the first releasing agent component has a content of 70 to 95% by mass, based on the total mass of the first releasing agent component and the second releasing agent component.

9. The image forming method of claim 1,
wherein a ratio of a sum of tertiary carbon atoms and quaternary carbon atoms is 0.1 to 20% in total carbon atoms constituting the hydrocarbon having the branched chain structure.

10. The image forming method of claim 1,
wherein a ratio of a sum of tertiary carbon atoms and quaternary carbon atoms is 0.1 to 1.0% in total carbon atoms constituting the hydrocarbon having the branched chain structure.

11. The image forming method of claim 1,
wherein a ratio of a sum of tertiary carbon atoms and quaternary carbon atoms is 0.3 to 1.0% in total carbon atoms constituting the hydrocarbon having the branched chain structure.

12. The image forming method of claim 1,
wherein the hydrocarbon having a branched chain structure is a microcrystalline wax.

13. The image forming method of claim 12,
wherein the microcrystalline wax has 30 to 60 carbon atoms, a weight-average molecular weight of 500 to 800 and a melting point of 60 to 90° C.

14. The image forming method of claim 1,
wherein a content of the release agent is 1 to 30% by mass based on a total mass of the toner.

15. The image forming method of claim 1,
wherein the toner comprises a colorant, and a content of the colorant is 1 to 30% by mass based on a total mass of the toner.

16. The image forming method of claim 1,
wherein the toner is produced via a coagulation/fusion process.

17. The image forming method of claim 1,
wherein the toner has a core/shell structure.

* * * * *